US005794510A

United States Patent [19]

Takano et al.

[11] Patent Number: 5,794,510

[45] Date of Patent: Aug. 18, 1998

[54] PRESSURIZED FLUID FEED SYSTEM

[75] Inventors: Toshiro Takano; Yoichi Netsu; Mitsumasa Akashi, all of Kanagawa, Japan

[73] Assignee: Komatsu Ltd., Japan

[21] Appl. No.: 617,758

[22] PCT Filed: Sep. 28, 1994

[86] PCT No.: PCT/JP94/01607

§ 371 Date: Mar. 15, 1996

§ 102(e) Date: Mar. 15, 1996

[87] PCT Pub. No.: WO95/09282

PCT Pub. Date: Apr. 6, 1995

[30] Foreign Application Priority Data

Sep. 28, 1993 [JP] Japan ..... 5-241120
Sep. 28, 1993 [JP] Japan ..... 5-241282

[51] Int. Cl.[6] ..... F15B 11/16

[52] U.S. Cl. ..... 91/517; 91/446

[58] Field of Search ..... 91/446, 448, 517

[56] References Cited

U.S. PATENT DOCUMENTS 4,508,013 4/1985 Barbagli ..... 91/517
5,062,350 11/1991 Tanaka et al. ..... 91/446
5,134,853 8/1992 Hirata et al. ..... 91/518

FOREIGN PATENT DOCUMENTS 59-38436 3/1984 Japan .
60-11706 1/1985 Japan .
244605 9/1992 Japan ..... 91/532
5-332306 12/1993 Japan .
5-332315 12/1993 Japan .

*Primary Examiner*—F. Daniel Lopez
*Attorney, Agent, or Firm*—Ronald P. Kananen

[57] ABSTRACT

A pressurized fluid feed system including a pressure compensating valve and directional control valve disposed between a hydraulic pump and a boom cylinder, and a pressure compensating valve and a directional control valve disposed between the hydraulic pump and a turning motor. Each pressure compensating valve comprise a check valve section and a pressure reduction valve section. The check valve section has an inlet port connected to the said hydraulic pump, an outlet port connected to the directional control valve, a spool for establishing and blocking communication between the inlet and outlet ports and a pressure chamber for applying pressure to the spool. The pressure reduction valve section has a first port connected to the said hydraulic pump, a second port connected to a reservoir, and a spool for establishing and blocking communication between the first and second ports. The check valve section of the pressure compensating valve for the turning motor allows a variable flow rate when the turning motor is singly operated and is moved to provide a fixed throttled flow when the boom cylinder and the turning motor are simultaneously operated. There is a check valve (118) connected between the pump and both the pressure chamber (63*a*) and the first port (42), which prevents communication between the pump and both the pressure chamber and the first port, when the boom cylinder and the turning motor are simultaneously operated.

2 Claims, 7 Drawing Sheets

PRESSURIZED FLUID FEED SYSTEM

FIELD OF THE INVENTION

The present invention relates to a pressurized fluid feed system for supplying a pressurized discharge fluid(s) from a single hydraulic pump or a plurality of hydraulic pumps to a plurality of hydraulic actuators, especially to a turning motor for a power shovel and a cylinder for a boom.

BACKGROUND OF THE INVENTION

A pressurized discharge fluid from a hydraulic pump, when it is supplied simultaneously into a plurality of hydraulic actuators, is forced to flow preferentially into an actuator of a lowest external load among various external loads acting on the respective actuators and hence cannot be supplied into a plurality of hydraulic actuators with varied external loads simultaneously.

In order to resolve this problem, there has hitherto been known, for example, a pressurized fluid feed apparatus as shown in FIG. 1 of the accompanying drawings hereof.

As shown in the Figure, the apparatus is provided in the discharge path 2 of a hydraulic pump 1 with a plurality of pressure compensating valves 3, each of the pressure compensating valves 3 being connected at its outlet side to an actuator 5 via a directional control valve 4. By setting these respective pressure compensating valves 3 at a highest load pressure, the actuators 5 having varying loads can be supplied simultaneously with a pressurized discharge fluid from the hydraulic pump 1.

More specifically, each pressure compensating valve 3 as mentioned above comprises a check valve section 6 and a pressure reduction valve section 7. The check valve section 6 is designed to increase and decrease the area of aperture between an inlet port 8 and an outlet port 9 whereas the pressure reduction valve section 7 is designed to establish and block a communication between a first port 10 and a second port 11. A spool in the pressure reduction valve section 7 is operatively thrusted in the communicating direction under a pressure at a first pressure receiving section 12 and is operatively thrusted in the blocking direction under a pressure at a second pressure receiving section 13. In addition, it is operative to act, by way of a rod 14, to push the check valve section 6 in the direction in which the the area of the aperture is reduced. The first port 10 of the respective pressure reduction valve section 7 is connected to the discharge path 2 of the hydraulic pump 1, the second port 11 has a self communication passage between the pressure reduction valve sections 7 and the first pressure receiving section 12 is connected to a respective load pressure detection circuit 15.

This being the case, where the load pressure of the left hand side actuator 5 is high and the load pressure of the right hand side actuator 5 is low in the construction in FIG. 1, the spool in the pressure reduction valve section 7 of the left hand side pressure compensation valve 3 will be thrusted in the communicating direction under a load pressure at the first pressure receiving section 12 and a pressurized fluid as commensurate with that load pressure will be delivered to the second port 11 and will act on the second pressure receiving section 13 of the pressure reduction valve section 7 of the right hand side pressure compensating valve 3. And, a low pressure load acts on the first pressure receiving section 12. Therefore, the spool in that pressure reduction valve section 7 will be thrusted in a direction tending to block a communication between the first port 10 and the second port 11. Then, since the area of the aperture of the right hand side check valve 6 under the action of the rod 14 is reduced smaller than the area of the aperture of the check valve section 6 of the left hand side pressure compensating valve 3, the pressurized discharge fluid from the hydraulic pump 1 can be delivered to each of the actuators of varying load pressures.

In a pressurized fluid feed apparatus as mentioned above, each pressure compensating valve 3 ought to be set at a highest load pressure. Thus, for example, in a case where a turning motor for a power shovel and a cylinder for a boom are simultaneously supplied with a pressurized fluid in order to elevate a boom while turning an upper vehicle body, the driving torque for the turning motor at the time of turning acceleration will be made large and will have a load pressure that is in excess of that for the boom cylinder. As a result, the area of the aperture of the check valve section 6 of the right hand side pressure compensating valve 3 as shown in FIG. 1 will be commensurate with the pump discharge pressure and the turning load pressure.

If from this state a turning operation is initiated at a constant speed after a termination of the turning acceleration, the driving torque for the turning motor will suddenly be decreased with a resultant sudden drop in the turning load pressure that is lowered than the load pressure for a boom cylinder (i. e. the load pressure for a booming operation). Accordingly, since the load pressure acting on the first pressure receiving section 12 of the reduction valve section 7 of the right hand side pressure compensating valve 3 in FIG. 1 is suddenly reduced and is suddenly thrusted in a direction tending to close the first port 10 and the second port 11 to suddenly throttle the area of the aperture of the check valve section 6, the driving pressure for the turning motor will suddenly be decreased. This will result in a lack of smoothness for the turning operation of the upper body, giving a sense of incompatibility to an operator in the driving chamber provided on the upper vehicle.

Especially, in a case where the upper vehicle body is a compact power shovel that is small and light weighted, the time period for the turning acceleration will be short. The development of the above-mentioned phenomenon subsequent to a termination of the turning acceleration during the time in which the boom is operatively elevated, will all the more give the operator a sense of incompatibility.

Accordingly, it is a primary object of the present invention to provide a pressurized fluid feed system in which where a boom cylinder and a turning motor are to be operated simultaneously, the smoothness of the turning operation for an upper vehicle body will not be deteriorated so as not to give a sense of incompatibility to an operator.

Also, it may be noted that what has basically an identical construction to that as shown in FIG. 1 has hitherto been known as disclosed, for example, in Japanese Laid-Open Patent Publication No. Sho 60-11706. In such a pressurized fluid feed system, each directional control valve is provided at an inlet side thereof with a pressure compensating valve, which is set by a highest load pressure among a variety of actuators so that the pressurized discharge fluid from the hydraulic pump may be supplied simultaneously to the actuators of various load pressures.

In this pressurized fluid feed system, a directional control valve is made capable of detecting a load pressure in order to enable load pressures of hydraulic actuators to be detected.

For example, as shown in FIG. 2 of the accompanying drawings hereof, a valve body 201 is formed, in its spool bore 202 with a pump port 203, a first and a second load pressure detecting port 204 and 205, a first and a second actuator port 206 and 207, and a first and a second tank port 208 and 209. In this construction, a communication is established between the first and second load pressure detecting ports 204 and 205. A main spool 210 that is fittedly inserted in the above mentioned spool bore 202 can be displaced leftwards and rightwards from a neutral position thereof to assume a first and a second pressurized fluid feed position, thereby enabling the pump port 203 to communicate with the first or the second actuator port 206 or 207 via the first and second load pressure detecting ports 204 and 205 while enabling the second or the first actuator port 207 or 206 to communicate with the second or first tank port 209 or 208 so that a load pressure of an actuator may be detected by the second load pressure detecting port 205.

In a directional control valve so constructed, it ensues that a pressurized fluid of a rate of flow that is proportional to the area of the aperture between the first actuator port 206 and the first load pressure detecting port 204 and the area of the aperture between the second actuator port 207 and the second load pressure detecting port 205, that is, say, which is proportional to the distance of displacement of the main spool 210 without regard to the magnitude of the load, even with a finely controlled but a slightly displaced position of the main spool 210, is supplied to an actuator and that as a consequence of a rapidly motivated acceleration of the actuator that is ready to move, the actuator comes to abruptly commence moving.

Also, in a case where the main spool 210 of the directional valve is stopped at an intermediate position between the pressurized fluid feed positions from its neutral position, it should ensue that a pressurized fluid of a rate of flow that is proportional to the area of the aperture is supplied to an actuator even though the actuator is in a high load state. Here again, the result is a lack of stability of the actuator.

Accordingly, the present applicant has previously filed a patent application for a directional control valve that is designed to resolve the above mentioned inconveniences.

More specifically, as shown in FIG. 3 of the accompanying drawings hereof, a directional control valve has been applied for a patent, in which the main spool 210 is formed with a communicating bore 211 designed to communicate the first load pressure detecting port 204 and the first actuator port 206 with each other and an opening 212 designed to communicate the second load pressure detecting port 205 and the second actuator port 207 with each other within a range in which the main spool 210 is slidably displaced by a given distance from its neutral position and in which the above mentioned communicating bore 211 is provided with a load checking valve 213 for blocking a flow of pressurized fluid from the first actuator port 206 to the first load pressure detecting port 204.

In such a directional control valve, if lying in a range in which the main spool 210 is displaced by a given distance from its neutral position, the pressurized discharge fluid of the hydraulic pump that is introduced in the first load pressure detecting port 204 will be prevented by the load checking valve 213 from flowing into the first actuator port 206 until the fluid pressure is elevated to a level that is commensurate with the load pressure of the actuator. In addition, a portion of the pressurized fluid will be caused to flow out of the opening 212 into the second tank port 209 via the second actuator port 207 in a rate of flow that is proportional to the load of an actuator. Thus, depending upon the load, the actuator will be slow to move in its initial period of movement, and the stability of an actuator is enhanced owing to the fact that the attenuation of movement is increased by the rate of flow of the fluid flowing out into the tank port.

If a directional control valve of this type is used with an actuator that is operated by an external force, however, an inconvenience does take place, for example, with a power shovel whose upper vehicle body needs to be turned by a turning motor and where, operating on a slope, the upper vehicle body attempts to be turned downwards by its own gravity.

For example, in a case where a turning motor 214 attempts to allow the upper vehicle body to turn in the direction of arrow by its own gravity, if the main spool 210 is displaced rightwards to feed the pressurized fluid from the first actuator port 206 into the first port **214*a* so that the turning motor 214 may rotate at a very low speed in the direction of arrow, it can be seen that although the second actuator port 207 and the second tank port 209 may communicate with each other when the main spool 210 is slightly displaced, it will be unable for the first load pressure detecting port 204 to communicate with the first actuator port 206**.

For this reason, the pressurized fluid of the second port **214*b* of the turning motor 214 will flow into the second tank port 209 from the second actuator port 207 to allow the turning motor 214 to rotate in the direction of arrow. Since the first port 14*a* is, however, then not to be fed with a pressurized fluid and thus is to be correspondingly evacuated, a cavitation will tend to develop in the first port 214*a* of the turning motor 214**.

In order to obviate this deficiency, it may be conceived to provide at the side of the first and second ports **214*a* and 214*b* of the turning motor, a suction valve 215 which acts to suck the pressurized fluid into the first port 214*a* from a reservoir 216. Since, however, this is in a controlled state in which the turning motor 214 is operating at a very low speed, the pressure in the reservoir circuit will not be at a full level and the pressurized fluid will not be supplied in an amount that is sufficient to fill the vacuum into the first port 214*a* of the turning motor 214. Hence, there will still remain a strong tendency for a cavitation to develop in the first port 214*a***.

When a cavitation develops in the first port **214*a* of the turning motor 214, a vibration will be induced in the turning motor 214** and its operability to carry out a very low speed control will become extremely difficult.

Accordingly, it is a second object of the present invention to provide a directional control valve which has an enhanced operability and which, with a turning motor in allowing an upper vehicle body to turn in a given direction by its own weight, is capable of eliminating the development of a cavitation when it is attempted to rotate the said turning motor at a very low speed in the said direction.

SUMMARY OF THE INVENTION

In order to attain the primary object set forth above, there is provided, in accordance with the present invention, in a first aspect thereof, a pressurized fluid feed system having a hydraulic pump, a boom cylinder and a turning motor, and including a pressure compensating valve and a directional control valve which are disposed between the said hydraulic pump and the said boom cylinder, and a pressure compensating valve and a directional control valve which are disposed between the said hydraulic pump and the said turning motor, in which the said pressure compensating valves each comprise:

a check valve section having an inlet port connected to the said hydraulic pump and an outlet port connected to the said directional control valve for controlling the area of the aperture between the said inlet port and the said outlet port, and a pressure reduction valve section having a first port connected to the said hydraulic pump, a second port connected to a reservoir, a first pressure receiving section connected to a load pressure detecting circuit for the said boom cylinder or the said turning motor, and a second pressure receiving section connected to the said second port, and which is operable under a pressure to the said first pressure receiving section in a direction in which the said first port and the said second port communicate with each other and which is operable under a pressure to the said second pressure receiving section in a direction in which a communication between the said first port and the said second port is blocked for driving the said check valve section in a direction in which a communication between the said inlet port and the said outlet port is closed; and in which each of the said two pressure compensating valves is set by a highest load pressure by establishing a communication between the said two second pressure receiving sections of the respective pressure reduction valve sections of the said two pressure compensating valves, characterized in that the said check valve section of the pressure compensating valve on the side of the said turning motor is provided with a variable flow rate control function when the said turning motor is singly operated and with a fixed throttling function when the said boom cylinder and the said turning motor are simultaneously operated.

According to a construction as mentioned above, in a case where a said boom cylinder and a said turning motor are operated simultaneously, it can be seen that a said check valve section of the pressure compensating valve on the side of the said turning motor will, at the time of turning acceleration, have an area of the aperture which is identical to that at the time of turning at a stationary speed and that since there is then not encountered a sudden change in the driving pressure for the said turning motor, there will develop no sense of incompatibility that is given to an operator.

In a construction as mentioned above, it should also be noted that it is preferred that:

the said check valve section of the pressure compensating valve on the side of the said turning motor be provided with a spool for establishing and blocking a communication between the said inlet port and the said outlet port and with a pressure chamber for applying a pressure to the said spool in the communicating direction;

the said spool be formed with a first notch for establishing and blocking a communication between the said inlet port and the said outlet port and a second notch for establishing and blocking a communication between the said pressure chamber and the said inlet port; and a discharge path of the said hydraulic pump be connected to the said pressure chamber and the said first port via a check valve so that a pressurized fluid may not flow through the said check valve when the said boom cylinder and the said turning motor are simultaneously operated and a pressurized fluid may flow through the said check valve when the said turning motor is singly operated.

In order to achieve the second object as set forth above, there is provided in accordance with the present invention, in a second aspect thereof, a directional control valve in which a valve body is formed in a spool bore thereof with a pump port, a first and a second load pressure detecting port, a first and a second actuator port and a first and a second tank port in such a manner that the said first and second load pressure detecting ports may communicate with each other;

a main spool is fittedly inserted in the said spool bore;

the said main spool can be disposed at a neutral position thereof to block a communication of any one of the said ports with another;

the said main spool can be displaced to assume a first pressurized fluid feed position to communicate the said pump port with the said second load pressure detecting port, to communicate the said first load pressure detecting port with the said first actuator port and to communicate the said second actuator port with the said second tank port; and the said main spool can be displaced to assume a second pressurized fluid feed position to communicate the said pump port with the said first load pressure detecting port, to communicate the said first actuator port with the said first tank port and to communicate the said second load pressure detecting port with the said second actuator port, characterized in that the said main spool can be displaced by a given distance from the said neutral position towards one of said first and said second pressurized fluid feed positions to communicate the said first actuator port with the said second actuator port via a load checking valve; and the said main spool can thereafter be further displaced to communicate one of the said first and second actuator ports with the said pump port while communicating the other of the said first and second actuator ports with one of the said first and second tank ports.

According to a construction as mentioned above, by virtue of the fact that when a said main spool is displaced towards one of a said first and a said second pressurized fluid feed position, there is established a communication between a said first actuator port and a said second actuator port and that when the said spool is thereafter displaced further, there are established a communication between one of the said first and second actuator ports and the said pump port and a communication between the other of the said first and second actuator ports and one of a said first and a said second tank port, it will be seen that a return pressurized fluid from an actuator that is operated by an external force can be supplied to the said actuator to prevent the said actuator from being rendered at a vacuum so that there may develop no cavitation in the said actuator.

In a construction as mentioned above, it should also be noted that it is preferred that:

the said main spool is formed with a first communicating bore for establishing and blocking a communication between the said first load pressure detecting port and the said first actuator port and with a second opening for establishing and blocking a communication between the said second load pressure detecting port and the said second actuator port;

the said main spool can be displaced by a given distance from the said neutral position towards the said first pressurized fluid feed position to allow the said first communicating bore to establish a communication between the said first load pressure detecting port and the said first actuator port while permitting the said second opening to establish a communication between the said second load pressure detecting port and the said second actuator port; and a said load checking valve is disposed in the said first communicating bore for blocking a flow of pressurized fluid from the said first actuator port into the said first load pressure detecting port.

BRIEF EXPLANATION OF THE DRAWINGS

The present invention will better be understood from the following detailed description and the drawings attached hereto showing certain illustrative embodiments of the present invention. In this connection, it should be noted that such embodiments as illustrated in the accompanying drawings are intended in no way to limit the present invention, but to facilitate an explanation and understanding thereof.

In the accompanying drawings.

BEST MODES FOR CARRYING OUT THE INVENTION

Hereinafter, suitable embodiment of the pressurized fluid feed system and the directional control valve according to the present invention will be set out with reference to the accompanying drawings.

Figure 1:
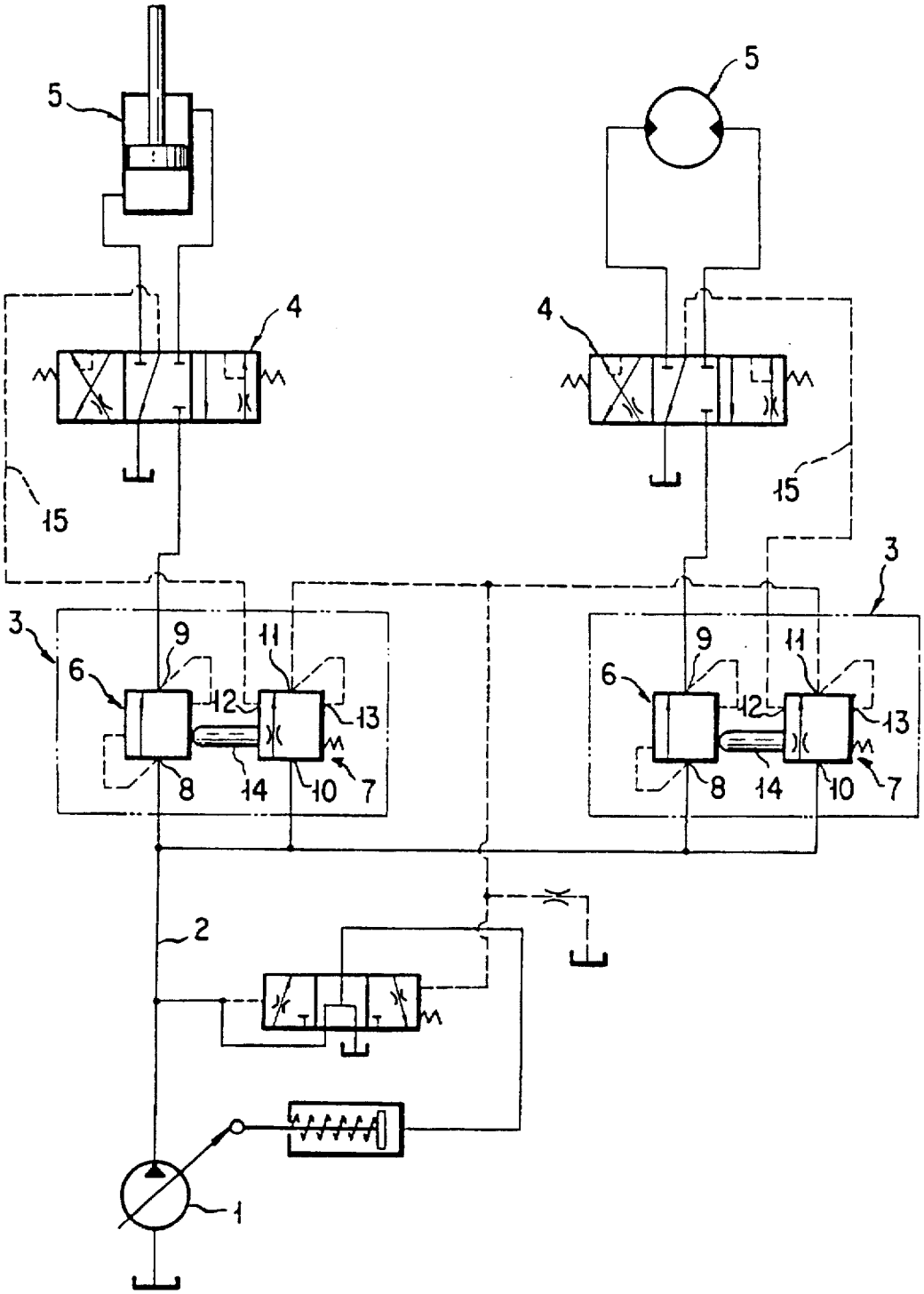
FIG. 1 is a hydraulic circuit diagram schematically illustrating a pressurized fluid feed system in the prior art.
Figure 2:
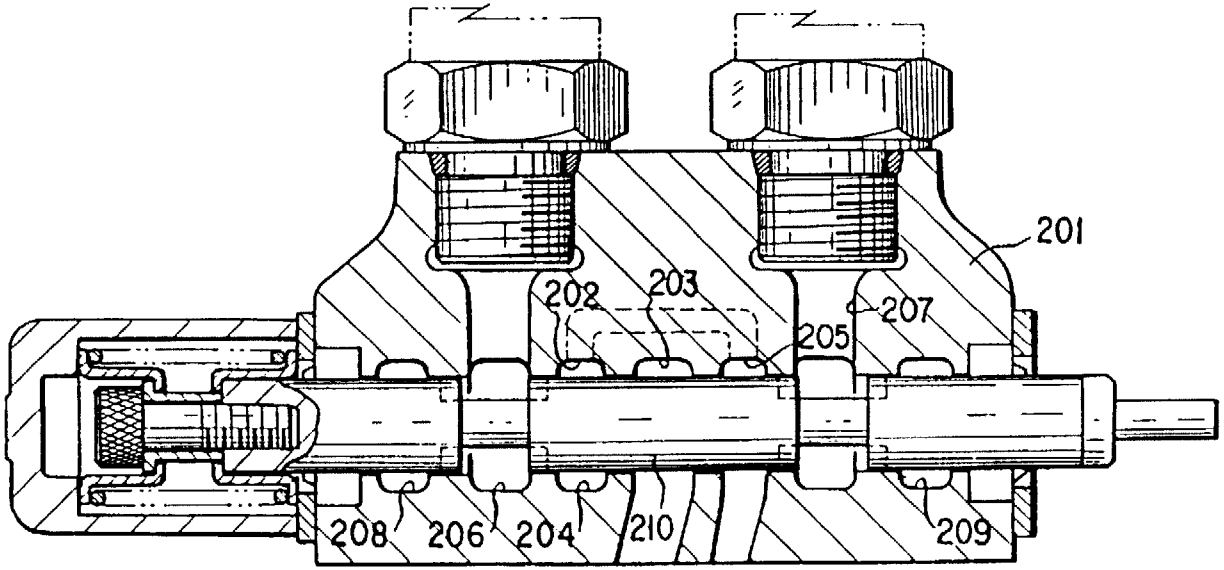
FIG. 2 is a cross sectional view schematically illustrating a directional control valve in the prior art.
Figure 3:
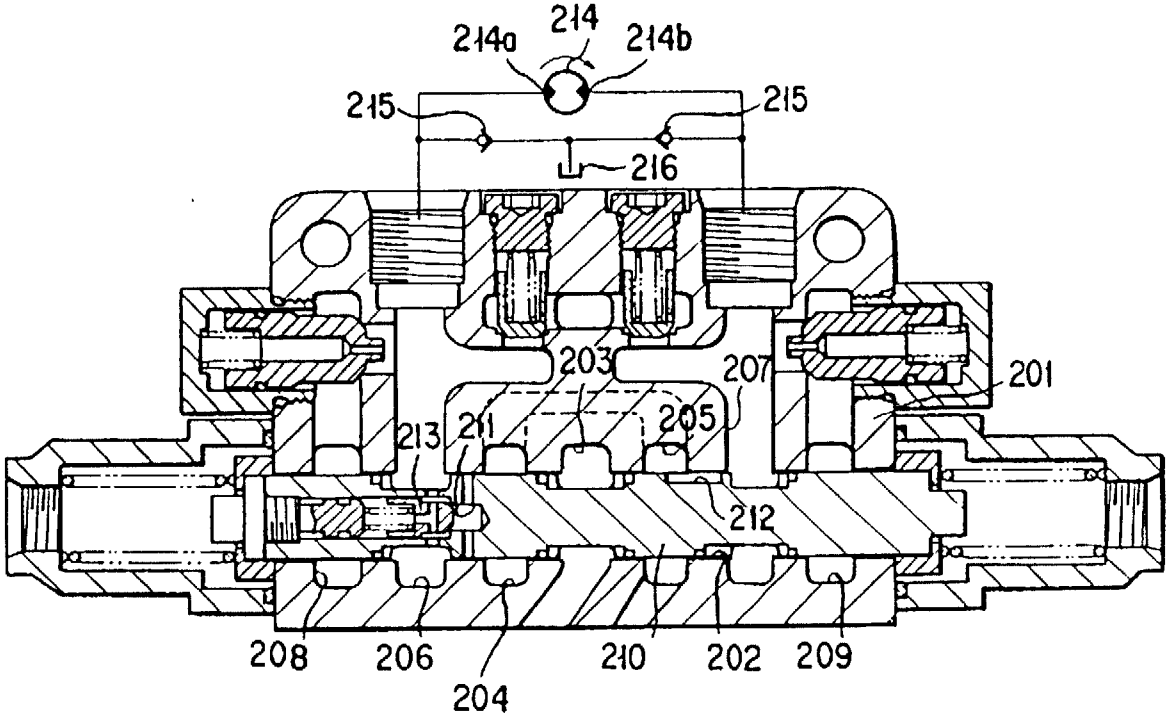
FIG. 3 is a cross sectional view schematically illustrating a directional control valve that is set forth in a patent application previously filed by the applicant.
Figure 4:
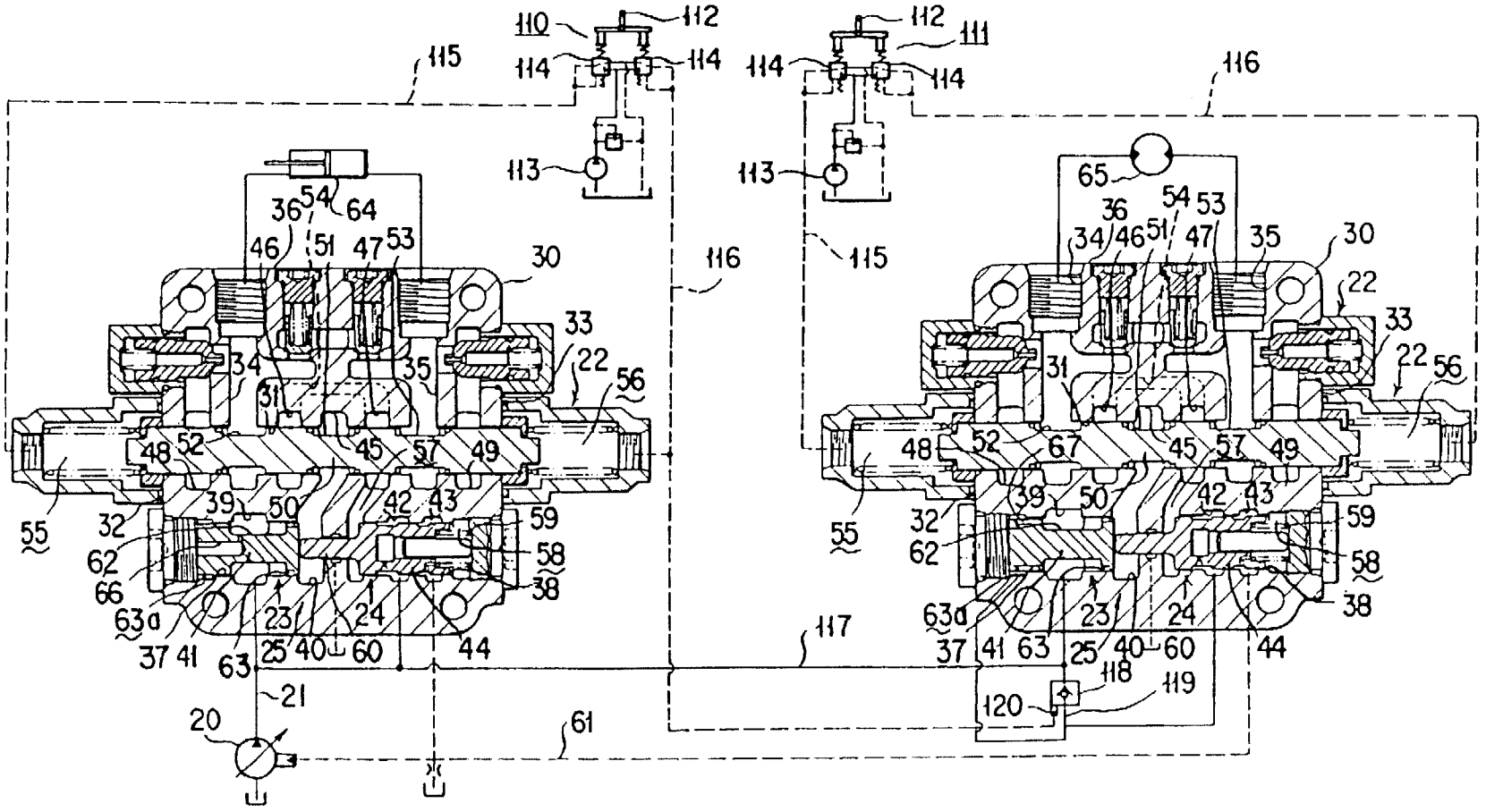
FIG. 4 is a diagrammatic view schematically illustrating a certain embodiment of the pressurized fluid feed system according to the present invention.

Referring now to FIG. 4 which shows a certain embodiment of the pressurized fluid feed system, a discharge path 21 of a hydraulic pump 20 is provided with a plurality of directional control valves 22 in parallel. At the inlet side of each directional control valve 22 there is provided a pressure compensating valve 25 which is constituted by a check valve section 23 and a pressure reduction valve section 24. Such a directional control valve 22 and a said pressure compensating valve 25 are provided in a valve block 30.

It will be seen that the said valve block 30 assumes an approximately rectangular parallelepiped configuration and is formed along its upper part with a spool bore 31 that is opening to a pair of left hand and right hand side surfaces 32 and 33. A first actuator port 34 and a second actuator port 35 that are open at their one ends to the said spool bore 31 is formed to be open at their other ends to an upper surface 36 of the said valve block 30. The said valve block 30 is formed along its lower part with a check valve bore 37 that is open to the said left hand side surface 32 and a pressure reduction valve bore 38 that is open to the said right hand side surface 33, the said check valve bore 37 and the said pressure reduction bore 38 extending coaxially with each other. A check valve spool 41 for establishing and blocking a communication between an inlet port 39 and an outlet port 40 opening to the above mentioned check valve bore 37 is fittedly inserted therein whereas a pressure reduction valve spool 44 for establishing and blocking a communication between a first port 42 and an outlet port 43 opening to the above mentioned reduction valve bore 38 is fittedly inserted therein.

The above mentioned valve block 30 is formed with a pump port 45 that is open to the said spool bore 31, a first load pressure detection port 46, a second load pressure detection port 47, the above mentioned first and second actuator ports 34 and 35, and a first and a second second tank port 48 and 49. A main spool 50 that is fittedly inserted into the said spool 31 is formed with a first, a second and a third small diameter portion 51, 52 and 53. In addition, the said valve block 30 is formed with a fluid bore 54 for communicating between a first and a second load pressure detection port 46 and 47.

The above mentioned main spool 50 is adapted to be held in its neutral position, in case neither a first pressure receiving chamber 55 nor a second pressure receiving chamber 56 is fed with a pressurized fluid, for blocking a communication between the respective ports, by means of a pair of springs. When the said first pressure receiving chamber 55 is fed with a pressurized fluid, the main spool is displaced to its first position at where it can be seen that the said first small diameter portion 51 will act to communicate the said pump port 45 with the said second load pressure detection port 47, the said second small diameter portion 52 will act to communicate the said first load pressure detecting port 46 with the said first actuator port 34, and the said third small diameter portion 53 will act to communicate the said second actuator port 35 with the said second tank port 49. When the said second pressure receiving chamber 56 is fed with a pressurized fluid, the main spool is displaced to its second position at where it can be seen that the said first small diameter portion 51 will act to communicate the said pump port 45 with the said first load pressure detecting port 46, the said second small diameter portion 52 will act to communicate the said first actuator port 34 with the said first tank port 48, and the said third small diameter portion 53 will act to communicate the said second load pressure detecting port 47 with the said second actuator port 35.

The above mentioned pressure reduction valve spool 44 will be thrusted under a pressure at a first pressure receiving section 57 in a direction in which the said first port 42 and the said second port 43 communicate with each other, and will be thrusted under a pressure at a second pressure receiving section 58 and by a spring 59 in a direction in which a communication between the said first port 42 and the said second port 43 is blocked while permitting the said check valve spool 41 to be thrusted by a rod 60 in a direction in which a communication between the said inlet port 39 and the said outlet port 40 is to be blocked. Then, the above mentioned outlet port 40 will communicate with the said pump port 45, the said first pressure receiving section 57 will communicate with the said second load pressure detecting port 47, and the said first pressure receiving section 58 will communicate with the said second port 43. And the said second ports 43 of the said pressure reduction valve sections 24 of the left hand side and right hand side pressure compensating valves 25 communicate with each other via a load pressure detecting circuit 61.

The above mentioned check valve spool 41 is formed with a small diameter portion 62 and a first notch 63 so that it may be thrusted under a pressure within a pressure chamber 63*a* in a direction in which the said inlet port 39 and the said outlet port 40 communicate with each other through the said first notch 63.

In the foregoing explanation, it should be noted that the said pressure compensating valves 25 as well as the said directional control valves 22 are identical to each other at both the side of a boom cylinder 64 and the side of a turning motor 65.

Figure 7:
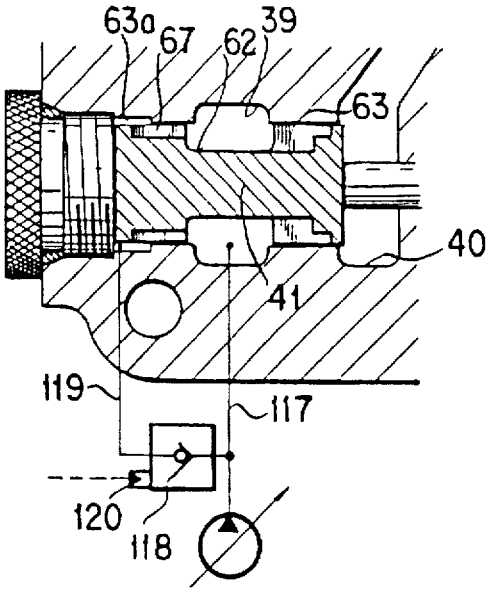
FIG. 7 is an enlarged cross sectional view schematically illustrating the check valve section in a pressure compensating valve that is employed in the above mentioned embodiment of the present invention.
Figure 8:
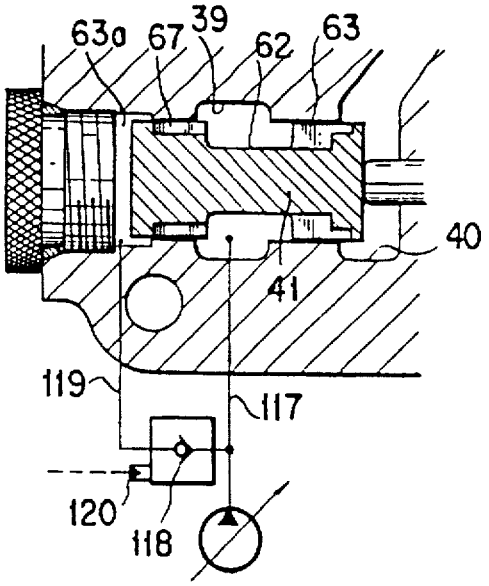
FIG. 8 is an enlarged cross sectional view schematically illustrating an operation of the above mentioned check valve section.

It can be seen that the said pressure chamber 63*a* of the said check valve section 23 of the said pressure compensating valve 25 on the side of the above mentioned boom cylinder 64 will communicate with the said small diameter portion 62 via a fluid bore 66 which allows a pressurized fluid to be fed into the said pressure chamber 63*a* from the said inlet port 39 whereas the said pressure chamber 63*a* of the said pressure compensating valve 25 on the side of the said turning motor 65 will communicate with the said small diameter portion 62 via a second notch 67 which allows a pressurized fluid to be fed into the said pressure chamber 63*a* from the said inlet port 39. If, however, the said spool 41 is displaced by a given distance from the state shown in FIG. 7 in a direction in which the said inlet port 39 and the said outlet port 40 communicate with each other, it can be seen that the pressurized fluid in the said inlet port 39 will no longer be fed into the said pressure chamber 63*a* owing to the fact that the said second notch 67 is displaced remote from the said pressure chamber 63*a* as shown in FIG. 8.

It will then be seen that a boom pilot pressure feed valve 110 and a turning pilot pressure feed valve 111 as shown in FIG. 4 can be operated by means of a pair of levers 112 to deliver the pressurized discharge fluids of a pair of pilot hydraulic pumps 113, after reduced by respective pressure reduction valves 114, into a first pilot conduit 115 and a second pilot conduit 116, respectively. The said first and second pilot conduits 115 and 116 which are connected to the said first and second pressure receiving sections 55 and 56 of the said directional control valves 22, respectively, are operated by means of the said levers 112 to displace the said main spools 50. For example, when the said operating lever 112 for the said boom pilot pressure feed valve 110 is operated to supply a pressurized pilot fluid into the second pressure receiving section 56 via the said second pilot conduit 116, the said main spool 50 will be slidably displaced leftwards to supply the pressurized discharge fluid of the said hydraulic pump 20 the said boom cylinder 64 from the said second actuator port 35, thereby operatively elevating the boom.

The said discharge path 21 of the said hydraulic pump 20 is connected via a passage 117 to the said inlet port 39, the said first port 42 of the said pressure compensating valve 25 of the said boom cylinder side and the said inlet port 39 of the said pressure compensating valve on the said turning motor side. The said passage 117 is connected via a check valve 118 to a passage 119, which are in turn connected to the said first port 42 and the said pressure chamber 63*a* of the said pressure compensating valve 25 of the said turning motor side.

It can be seen that it the above mentioned check valve 118 a pressure (i. e. an open valve pressure) of the said passage 117 which is caused by a flow from the said passage 117 to the said passage 119 will be controlled by a pilot pressure (as an external signal) which is supplied to a pressure receiving section 120. To the said pressure receiving section 120 there is connected the said second pilot conduit 116 of the said boom pilot feed valve 110.

Figure 5:
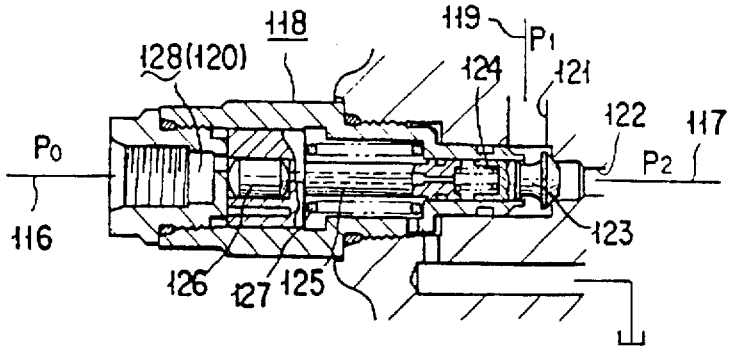
FIG. 5 is a detailed diagrammatic view schematically illustrating a check valve that is employed in the above mentioned embodiment of the present invention.

With respect to the above mentioned check valve 118, for example, as shown in FIG. 5, it is noted that it is comprised of a puppet 123 that is adapted to establish and block a communication between a fluid bore 121 and a port 122, a spring 124 that is adapted to push the said puppet 123 in its closing direction, a piston 125 that is adapted to push this spring 124 and the puppet 123, a balancing piston 126 with which the said piston 125 is in an abutting engagement and a spring 127 that is adapted to push the said piston 125. The said check valve 118 is thus so constructed that when the pressure P0 of a pressurized fluid supplied into the pressure receiving portion 120 of the piston 125 exceeds a given value, the open valve pressure of the said puppet 123, that is, the differential pressure between the pressure P2 of the said port 122 and the pressure P1 of the said fluid bore 121 when the said puppet 123 is opened may be progressively increased in proportion to the hydraulic pressure. Thus, the said fluid bore 121 is connected to the said passage 119, the said port 122 is connected to the said passage 117 and the said pressure receiving section 120 is connected to the said second pilot conduit 116.

While in the above mentioned example a pressurized fluids used to push a balancing piston, a proportional solenoid may be used to push them. Namely, the open valve pressure of the said check valve 118 can be progressively increased in response to an external signal.

An explanation will now be given with respect to the operation of the system so far set forth.

Figure 6:
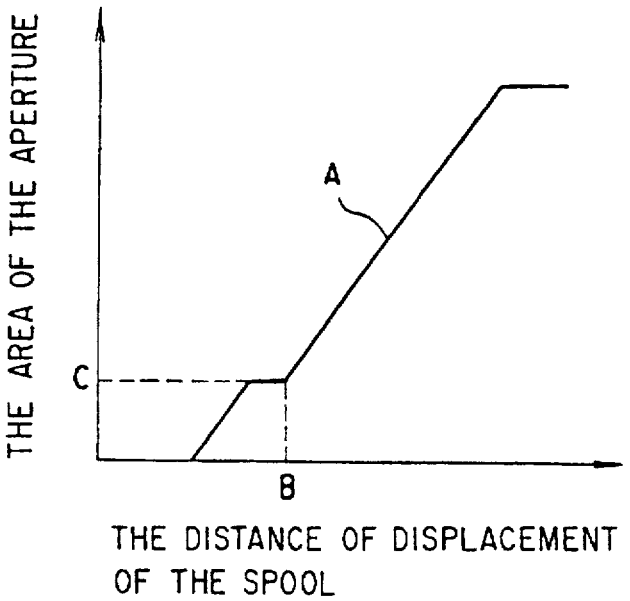
FIG. 6 is a graph schematically illustrating the relationship of the area of the aperture with respect to the distance of displacement of the spool in the check valve section that is employed in the above mentioned embodiment of the present invention.

Assume first a case in which the said boom cylinder 64 is made inoperative. Since a pressurized pilot fluid is then not supplied to the said pressure receiving section 120 of the said check valve 118, the open valve pressure for the said check valve 118 is significantly of a low value. As the low pressurized fluid of the said passage 117 is supplied via the said passage 119 into the said first port 42 of the said pressure compensating valve 25 on the side of the said turning motor 65, it will also be fed into the said pressure chamber 63*a* . As a consequence, the said check valve spool 41 will then be displaced by a predetermined distance in the communicating direction. Since if the said second notch 67 is then closed the said pressure chamber 63*a* is supplied with a pressurized fluid of the said input port 39, the area of the aperture of the said inlet port 39 and the said outlet port 40 will, as shown by the line A in the graph of FIG. 6, be progressively enlarged, thus capable of supplying a pressurized fluid to the said turning motor 65 as in the prior art.

Then, assume a case in which the said boom cylinder 64 and the said turning motor 65 are simultaneously operated. Then, a pressurized pilot fluid will be supplied into the said pressure receiving section 120 of the said check valve 118 from the said second pilot conduit 116, and the open valve pressure for the said check valve 118 will then be progressively increased in proportion to the force of the said pressurized pilot fluid.

As a result, with the pressure of the said passage 117, that is, the discharge pressure of the said hydraulic pump 20 being not supplied into the said first port 42 or into the said pressure chamber 63*a* of the said pressure compensating valve 25 on the side of the said tuning motor 65 via the said passage 119, the said pressure reduction valve spool 44 will be thrusted by the load pressure of the said turning motor 65. If the said first port 42 and the said second port 43 then communicate with each other, the turning load pressure will not be detected by the said load pressure sensing circuit 61 via the said second port 43. Therefore, it can be seen that each of the said pressure compensating valves 25 will be set by a load pressure of the said boom cylinder.

Also, as shown in FIG. 8, if the said check valve spool 41 of the said pressure compensating valve 25 on the said turning motor side is displaced with a predetermined distance in a direction in which the said inlet port 39 and the said outlet port 40 communicate with each other, it can be seen that the said second notch 67 will be closed not to supply a pressurized fluid of the said inlet port 39 into the said pressure chamber 63*a* with the result that there will no longer be a force capable of thrusting the said check valve spool 41 in the above mentioned direction. Thus, the stroke displacement can only reach up to that position (i. e. the position B in the graph of FIG. 6) so that the area of the aperture between the said inlet port 39 and the said outlet port 40 of the said first notch 63 of the said check valve 41 may not exceed a value shown by the position C in the graph of FIG. 6.

This being the case, where the said boom cylinder and the said turning motor is to be simultaneously operated, it follows that the said pressure compensating valves 25 will, at the time of turning acceleration as well as at the time of turning at a stationary speed after the turning acceleration is terminated, be set by the the boom load pressure so that the area of the aperture of the said check valve 23 may not change substantially.

More specifically, it should be noted that at the time of turning acceleration, a state in which a pressure compensation is made will be brought about with the said check valve 23 throttled to make its area of aperture identical to that at the time of turning with a stationary speed. As a result, the turning load pressure at the time of turning acceleration will be made identical to the turning load pressure at the time of turning with a stationary speed after the turning acceleration is terminated.

Accordingly, there will not be a sudden change in the turning drive pressure for a turning motor and there will not develop a sense of incompatibility that is given to an operator.

Figure 9:
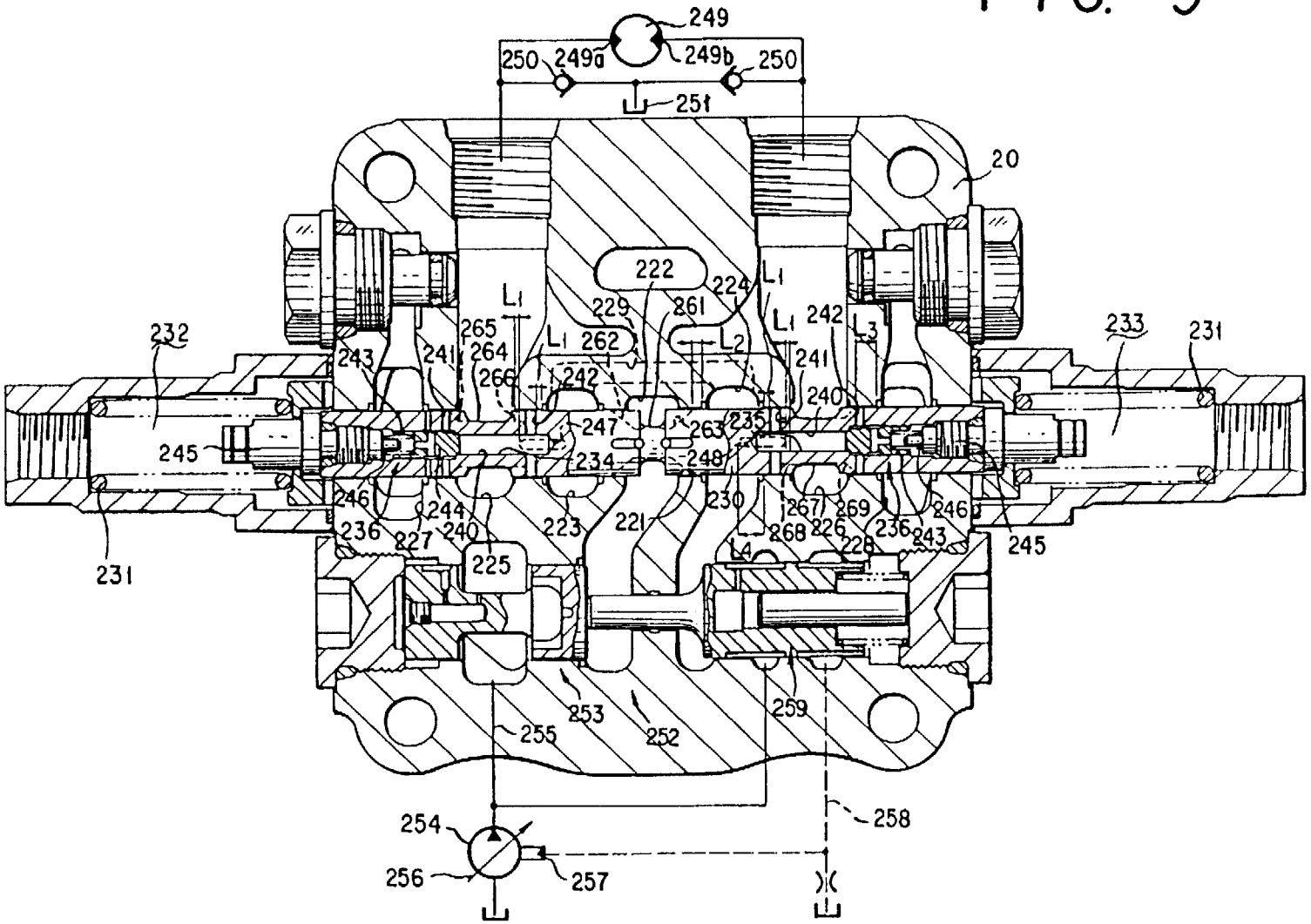
FIG. 9 is a cross sectional view schematically illustrating a certain embodiment of the directional control valve according to the present invention.

Referring now to FIG. 9 which shows a certain embodiment of the directional control valve according to the present invention, a valve body 220 is formed, in a spool bore 221 thereof, with a pump port 222, a first and a second load pressure detecting port 223 and 224, a first and a second actuator port 225 and 226 and a first and a second tank port 227 and 228, and the said first and second load pressure detecting ports 223 and 224 is communicating with each other at a fluid bore 229.

A main spool 230 that is fittedly inserted in the above mentioned spool bore 221 is formed with an intermediate small diameter portion 261, a first and a second notch 262 and 263, a first small diameter portion 264, a third and a fourth notch 265 and 266, a second small diameter portion 267 and a fifth and a sixth notch 268 and 269. The said main spool 230 is held at a neutral position thereof with a left hand side and a right hand side spring 231 and 231 so as to block a communication from any one of the said ports from another. The said main spool 230 with a pressurized fluid fed into a first pressure receiving chamber 232 is also adapted to be thrusted rightwards to assume a first pressurized fluid feed position. Also, with a pressurized fluid fed into a second pressure receiving chamber 233 the said main spool 230 is adapted to be thrusted leftwards to assume a second pressurized fluid feed position.

The above mentioned main spool 230 is formed with a first communicating bore 234 for establishing and blocking a communication between the said first load pressure detecting port 223 and the said first actuator port 225 and a second communicating bore 235 for establishing and blocking a communication between the said second load pressure detecting port 224 and the said second actuator port 226. The said first and second communicating bores 234 and 235 are each provided with a load checking valve 236 for blocking a flow of pressurized fluid from a said actuator port into a said load pressure detecting port.

The above mentioned first and second communicating bore 234 and 235 each comprise an axial bore 240 and a pair of radially extending first and second fluid bores 241 and 242 whereas the above mentioned load checking valve 236 is provided with a valve 244 in a blind hole 243 that is formed at an axial portion of the said main spool 230. A spring 246 is provided between the said valve 244 and a plug 245 to make the valve 244 in an abutting engagement with the said axial bore 240.

The above mentioned main spool 230 is formed with a first slit-like opening 247 for establishing and blocking a communication between the said first load pressure detecting port 223 and the said first actuator port 225 and a second slit-like opening 248 for establishing and blocking a communication between the said second load pressure detecting port 224 and the said second actuator port 226.

The above mentioned first and second actuator ports 225 and 226 are connected to a first and a second port 249*a* and 249*b* of a turning motor 249, respectively, the turning motor being adapted to turn, for example, the upper vehicle body of a power shovel. In this case, the sides of these first and second ports 249*a* and 249*b* are in communication with a reservoir 251 via a suction valve 250.

The above mentioned pump port 222 is connected to a discharge path 255 of a hydraulic pump 254 via a check valve section 253 that constitutes a pressure compensating valve 252. The said hydraulic pump 254 is of the type in which its capacity is varied by changing the sloping angle of a swash plate 256. To this end, a load pressure detecting path 258 is provided that is connected to a pump adjustment directional control valve 257 for varying the sloping angle of the swash plate 256. Furthermore, there is provided a pressure reduction valve section 259 that constitute the above mentioned pressure compensating valve 252 and designed for establishing and blocking a communication between the said discharge path 255 of the hydraulic pump 254 and the said load pressure detecting path 258.

An explanation will now be given with respect to the operation of the apparatus so far set forth. Before further proceeding, it should be noted that the turning motor 249 is assumed to be of the type which is rotated in a direction in which the pressurized fluid is discharged into the second port 249*b* by virtue of the weight of the upper vehicle body.

First, assume the state in which the said main spool 230 lies in its neutral position as shown in FIG. 9:

Each of the said ports will be blocked so that the pressurized fluid introduced into said the pump port 222 may find a blind end. At the same time, the pressurized fluids from the said first and said second ports 249*a* and 249*b* of the said turning motor 249 will come to a dead end. This will bring the said turning motor 249 into the state in which it cannot be rotated by an external force, and will then cause the upper vehicle body of a power shovel on a slope to come to a stop without turning by its own gravity.

Assume then the state in which the said main spool 230 is slightly displaced by a distance L1 rightwards from its neutral position:

The said second opening 248 will act to establish a communication between the said second load pressure detecting port 224 and the said second actuator port 226. At the same time, the said first communicating bore 234 will act to establish a communication between the said first load pressure detecting port 223 and the said first actuator port 225.

At this time, however, the said second notch 263 will not still act to establish a communication between the said pump port 222 and the said second load pressure detecting port 224 whereas the said fourth notch 266 will not still act to establish a communication between the said first load pressure detecting port 223 and the said first actuator port 225. In addition, the said sixth notch 269 will not still act to establish a communication between the said second actuator port 226 and the said second tank port 228.

This will cause the pressurized fluid of the said second port 249*b* of the said turning motor 249 to flow through the said second actuator port 226, the said second opening 248, the said second load pressure detecting port 224, the said fluid bore 229, the said first load pressure detecting port 223, the said first communicating bore 235 and the said first actuator port 225 into the said first port 249*a* of the said turning motor 249. Since this in turn enables the pressurized fluid of the said second port 249*b* of the said turning motor 249 to be fed into its first port 249*a* before the latter is fed with the pressurized fluid of the hydraulic pump 254, the said first port 249*a* will no longer be rendered at a vacuum, thereby preventing a cavitation from being developed therein. Hence, a very low velocity control is made possible for the said turning motor 249.

Assume, then, the state in which the said main spool 230 is further displaced rightwards by a distance L2 (>L1) from the preceding state:

Whereas the said intermediate small diameter portion 261 and the said second notch 263 will act to communicate the said pump port 222 with the said second load pressure detecting port 224, the sixth notch 269 will still act to block a communication between the said second actuator port 226 and the said second tank port 228.

This will cause the pressurized discharge fluid from the hydraulic pump 254 to flow through the said pump port 222, the said intermediate small diameter portion 261, the said second notch 263, the said second load pressure detecting port 224, the said fluid bore 229, the said first load pressure detecting port 223 and the said first communicating bore 234 and immediately in advance of the said load checking valve 236, and will then cause the pressurized discharge fluid of the said hydraulic pump 254 to come to a blind end. Accordingly, the discharge pressure of the said hydraulic pump 254 will be elevated. When that discharge pressure is elevated to a pressure of retention acting on the said load checking valve 236, the latter will be opened and the pressurized discharge fluid of the said hydraulic pump 254 will, by the action of the said load checking valve 236, be fed through the said first bore 241 into the said first port 249*a* of the said turning motor 249 via the said first actuator port 225.

Assume, next, the state in which the said main spool 230 is displaced rightwards by a distance L3 (>L2) from the preceding state:

A communication will now be established of the said second actuator port 226 with the said second tank port 228 via the said sixth notch 269 to allow a portion of the pressurized discharge fluid of the said hydraulic pump 254 to flow out of the said second opening 248 into the said second tank port 228 at a rate of flow that is proportional to the magnitude of a load pressure (i. e. a pressure of retention of the said turning motor 249) acting on the said first actuator port 225. Thus, when the load (i. e. retention pressure) of the said turning motor 249 is large, the rate of flow into the said second tank port 228 will be increased. Conversely, when the load pressure is small, the rate of flow into the said second tank port 228 will be reduced. The result is that the acceleration of the said turning motor 249 when it commences moving will become gentle in accordance with the load and there will then no longer be a feel of abrupt start. In addition, there will be an enhanced stability of the said turning motor 249 by virtue of the fact that the rate of flow into the said second tank port 228 will enlarge an attenuation of movement.

In this connection, it should be noted that since the above mentioned second slit-like opening 248 is much smaller in the area of aperture than the said sixth notch 269 and the said first communicating bore 234, there will be no excessive slowing in the acceleration of the said turning motor 249 due to the rate of flow into the said second tank port 228.

Finally, assume the state in which the said main spool 230 is further displaced rightwards by a distance L4 (>L3) from the preceding state:

The said second slit-like opening 248 will not act to establish a communication between the said second load pressure detecting port 224 and the said second actuator port 226 to allow the pressurized discharge fluid of the said hydraulic pump 254 to flow at a rate of flow that is proportional to the areas of the apertures of the said first load pressure detecting port 223 with the said first small diameter portion 264 and the said second notch 266 of the said main spool 230 and the said first actuator port 225, thereby accelerating the operating speed of the said turning motor 249.

While the foregoing explanation has been directed to the cases in which the said main spool 230 is displaced rightwards, it should be noted that in a case where the said turning motor 249 is rotated in a direction in which the pressurized fluid is discharged from the said first port 249*a* owing to the weight of the said upper vehicle body, similar cases apply when the said main spool 230 are displaced leftwards.

Also, in a case where an actuator, such as with a boom cylinder or an arm cylinder, is operated only in a single direction by an external force, it will suffice to provide only one of the first and second openings 247 and 248 and one of the first and second communicating bores 234 and 235.

While the present invention has hereinbefore been described with respect to certain illustrative embodiments thereof, it will readily be appreciated by a person skilled in the art to be obvious that many alterations thereof, omissions therefrom and additions thereto can be made without departing from the essence and the scope of the present invention. Accordingly, it should be understood that the present invention is not limited to the specific embodiments thereof set out above, but includes all possible embodiments thereof that can be made within the scope with respect to the features specifically set forth in the appended claims and encompasses all equivalents thereof.

What is claimed is:

1. A pressurized fluid feed system having a hydraulic pump, a boom cylinder and a turning motor, and including a pressure compensating valve and a directional control valve which are disposed between said hydraulic pump and said boom cylinder, and a pressure compensating valve and a directional control valve which are disposed between said hydraulic pump and said turning motor, in which said pressure compensating valves each comprise:

a check valve section having an inlet port connected to said hydraulic pump and an outlet port connected to said directional control valve for controlling an area of an aperture between said inlet port and said outlet port, and a pressure reduction valve section having a first port connected to said hydraulic pump, a second port connected to a reservoir, a first pressure receiving section connected to a load pressure detecting circuit for said boom cylinder or said turning motor, and a second pressure receiving section connected to said second port, and which is operable under a pressure to said first pressure receiving section in a direction in which said first port and said second port communicate with each other and which is operable under a pressure to said second pressure receiving section in a direction in which a communication between said first port and said second port is blocked for driving said check valve section in a direction in which a communication between said inlet port and said outlet port is closed; and in which each of said two pressure compensating valves is set by a highest load pressure by establishing a communication between the said two second pressure receiving sections of the respective pressure reduction valve sections of said two pressure compensating valves, characterized in that said check valve section of the pressure compensating valve on the side of said turning motor is provided with a variable flow rate control function when said turning motor is singly operated and with a fixed throttling function when said boom cylinder and said turning motor are simultaneously operated.

2. A pressurized fluid feed system as set forth in claim 1, characterized in that said check valve section of the pressure compensating valve on the side of said turning motor is provided with a spool for establishing and blocking a communication between said inlet port and said outlet port and with a pressure chamber for applying a pressure to said spool in the communicating direction;

said spool is formed with a first notch for establishing and blocking a communication between said inlet port and said outlet port and a second notch for establishing and blocking a communication between said pressure chamber and said inlet port; and a discharge path of said hydraulic pump is connected to said pressure chamber and said first port via a check valve so that a pressurized fluid will not flow through said check valve when said boom cylinder and said turning motor are simultaneously operated and a pressurized fluid will flow through said check valve when said turning motor is singly operated.

* * * * *